US008833587B2

(12) United States Patent
Forsyth et al.

(10) Patent No.: US 8,833,587 B2
(45) Date of Patent: Sep. 16, 2014

(54) REUSABLE BEVERAGE CUP

(75) Inventors: Abigail Forsyth, Fitzroy (AU); Jamie Forsyth, Fitzroy (AU)

(73) Assignee: KeepCup Pty Ltd., Fitzroy, Vic (AU)

( * ) Notice: Subject to any disclaimer, the term of this patent is extended or adjusted under 35 U.S.C. 154(b) by 0 days.

(21) Appl. No.: 13/323,601

(22) Filed: Dec. 12, 2011

(65) Prior Publication Data

US 2013/0146593 A1 Jun. 13, 2013

(51) Int. Cl.
*B65D 51/16* (2006.01)
*B65D 51/18* (2006.01)

(52) U.S. Cl.
USPC ..... 220/254.4; 220/367.1; 220/821

(58) Field of Classification Search
USPC ..... 220/254.1, 254.3, 254.4, 254.7, 203.05, 220/366.1, 367.1, 820, 785, 703, 831, 832, 220/834; 206/459.5; 222/516, 51, 518
See application file for complete search history.

(56) References Cited

U.S. PATENT DOCUMENTS

| | | | | | |
|---|---|---|---|---|---|
| 264,696 | A * | 9/1882 | Henkel | 225/93 |
| 1,765,128 | A * | 6/1930 | Conover | 222/498 |
| 2,033,042 | A * | 3/1936 | Mazzella | 220/821 |
| 2,780,395 | A * | 2/1957 | Schlabach et al. | 222/516 |
| 2,943,771 | A * | 7/1960 | Driscoll | 222/512 |
| 2,991,897 | A * | 7/1961 | Burnett | 215/21 |
| 3,169,679 | A * | 2/1965 | Hunter | 222/484 |
| 3,212,665 | A * | 10/1965 | Duncan | 220/233 |
| 4,106,665 | A * | 8/1978 | Cannon | 220/820 |
| 4,164,303 | A * | 8/1979 | Waterbury | 220/834 |
| 4,232,797 | A * | 11/1980 | Waterbury | 220/834 |
| 4,760,934 | A * | 8/1988 | Netsch | 220/269 |
| 5,443,175 | A * | 8/1995 | Kelly et al. | 220/298 |
| 5,699,927 | A * | 12/1997 | Lane et al. | 220/254.3 |
| 5,755,354 | A * | 5/1998 | Lang | 220/689 |
| 5,921,425 | A * | 7/1999 | Markey | 220/254.4 |
| 6,036,045 | A * | 3/2000 | West | 220/560.04 |
| 6,212,803 | B1 * | 4/2001 | Key | 40/324 |
| 6,315,145 | B1 * | 11/2001 | Fask et al. | 220/254.1 |
| 6,644,490 | B2 * | 11/2003 | Clarke | 220/254.1 |
| 6,763,964 | B1 * | 7/2004 | Hurlbut et al. | 220/254.3 |
| 7,083,103 | B2 * | 8/2006 | Hull | 235/487 |
| 7,581,640 | B2 * | 9/2009 | Lopez | 206/459.1 |
| 7,731,047 | B2 * | 6/2010 | Ishimitsu | 220/254.4 |
| 7,975,868 | B1 * | 7/2011 | Flies et al. | 220/524 |
| 2003/0052126 | A1 * | 3/2003 | Zettle et al. | 220/254.3 |
| 2003/0089714 | A1 * | 5/2003 | Dart et al. | 220/254.3 |
| 2004/0118847 | A1 * | 6/2004 | Giraud | 220/254.3 |
| 2005/0150889 | A1 * | 7/2005 | Perra | 220/254.1 |
| 2007/0012698 | A1 * | 1/2007 | Durdon et al. | 220/253 |
| 2007/0029322 | A1 * | 2/2007 | Durdon et al. | 220/254.4 |
| 2007/0039960 | A1 * | 2/2007 | Pawlik | 220/254.7 |
| 2008/0110785 | A1 * | 5/2008 | Rocco | 206/459.5 |
| 2009/0294460 | A1 * | 12/2009 | Hovsepian et al. | 220/713 |
| 2012/0168442 | A1 * | 7/2012 | Bradley | 220/269 |

* cited by examiner

*Primary Examiner* — Fenn Mathew
*Assistant Examiner* — Robert Stodola
(74) *Attorney, Agent, or Firm* — Workman Nydegger

(57) ABSTRACT

A reusable beverage cup comprising a container, a lid having an opening and adapted to fit on the container, and a rotatable member on the lid having a plug that is adapted to locate in the opening when the rotatable member is in a first position on the lid, wherein the plug and opening are similar in shape and sealingly close the opening.

11 Claims, 8 Drawing Sheets

REUSABLE BEVERAGE CUP

BACKGROUND OF THE INVENTION

1. Field of the Invention

The present invention relates to beverage cups and more particularly to a reusable take-away beverage cup.

2. Description of the Related Art

Most coffee outlets across the world provide coffee lovers with coffee in disposable paper cups. These paper cups have inner polyurethane linings that hold the coffee piping hot for hours. However, polyurethane is not biodegradable and billions of disposable paper cups are used every year across the globe. Therefore, use of disposable paper cups results in creation of non-biodegradable toxic waste and destruction of forests.

Efforts have been made over the years to replace the ubiquitous disposable paper cups. These reusable cups are made of various materials from steel, ceramic to silicone. However, not all the reusable cups are easy to use. These reusable cups usually provide a concave surface along the sipping hole which unevenly distributes the flow of the beverage. Moreover, uneven distribution of the flow can create spillage and cause inconvenience to the user.

Known reusable cups incorporate a cover over the sipping hole that opens with a shaky unidirectional movement. These cups fail to provide means for releasing the steam or hot air and have a tendency to lock the air within them. Therefore, these cups are more prone to accidental openings and spillage, when users such as children and elderly people try to open them.

What is needed is a reusable cup that overcomes the problems identified above and provides a reusable drinking cup that is simple and safe to repeatedly use.

SUMMARY OF THE INVENTION

In accordance with the present invention there is provided a reusable beverage cup comprising a container; a lid having an opening and adapted to fit on the container; and a rotatable member on the lid having a plug that is adapted to locate in the opening when the rotatable member is in a first position on the lid, wherein the plug and opening are similar in shape and sealingly close the opening A preferred embodiment of a reusable take-away beverage container is disclosed herein. The container is wrapped with an insulating sleeve and enclosed by a lid. The lid comprises a triangular shaped opening, a triangular shaped indent, a circular shaped indent, a central indented area and an air hole. The air hole provides a vent for releasing hot air or steam from the container or letting air in. The central indented area has a circular configuration that has a plurality of projections configured to receive a rotating member.

In the embodiment described herein the rotating member has a central circular protrusion that engages with the central indented area of the lid. The plug swivels or turns between a first position and a second position over the lid at a predefined angle. The rotatable member has a triangular protrusion adapted to snap fit into the triangular shaped opening to define the first position of the rotatable member. The triangular protrusion of the rotatable member snap fits into the triangular shaped indent to define the second position of the rotating member. The plug has an under surface that has an arcuate shaped guiding track. The guiding track defines a slot along the periphery of the rotating member. The slot is adapted to carry the hot air or steam released by the air hole.

In an embodiment the under surface of the plug includes a circular protrusion defined besides the guiding track. The circular protrusion is adapted to be positioned over the air hole in the first position of the guiding member. The lid defines an indentation adapted to be positioned with the circular protrusion in the second position of the rotatable member.

In a preferred embodiment, the container has a tapered configuration adapted to fit into a variety of heads of coffee vending machines. The container has an inner wall marked with a plurality of predefined circular markings. The circular markings indicate a plurality of predefined beverage volumes. The sleeve provides a plurality of user customizable personalization marks. The personalization marks are configured to be highlighted using a marker or high-lighter.

The lid may include a bulged arcuate portion adapted to define the boundaries within which the guiding member is allowed to turn or swivel over the lid. The sipping hole of the lid is accessible by a dual movement of the rotating member. The dual movement of the rotating member includes an upward and a lateral movement of the rotatable member. The triangular shaped opening laterally distributes and controls the flow of the beverage.

BRIEF DESCRIPTION OF DRAWINGS

The above mentioned and other features, aspects and advantages of the present invention will become better understood with regard to following description, appended claims and accompanying drawings, wherein like reference numerals refer to similar parts throughout the several views where:

DESCRIPTION OF THE PREFERRED EMBODIMENT OF THE INVENTION

Figure 1:
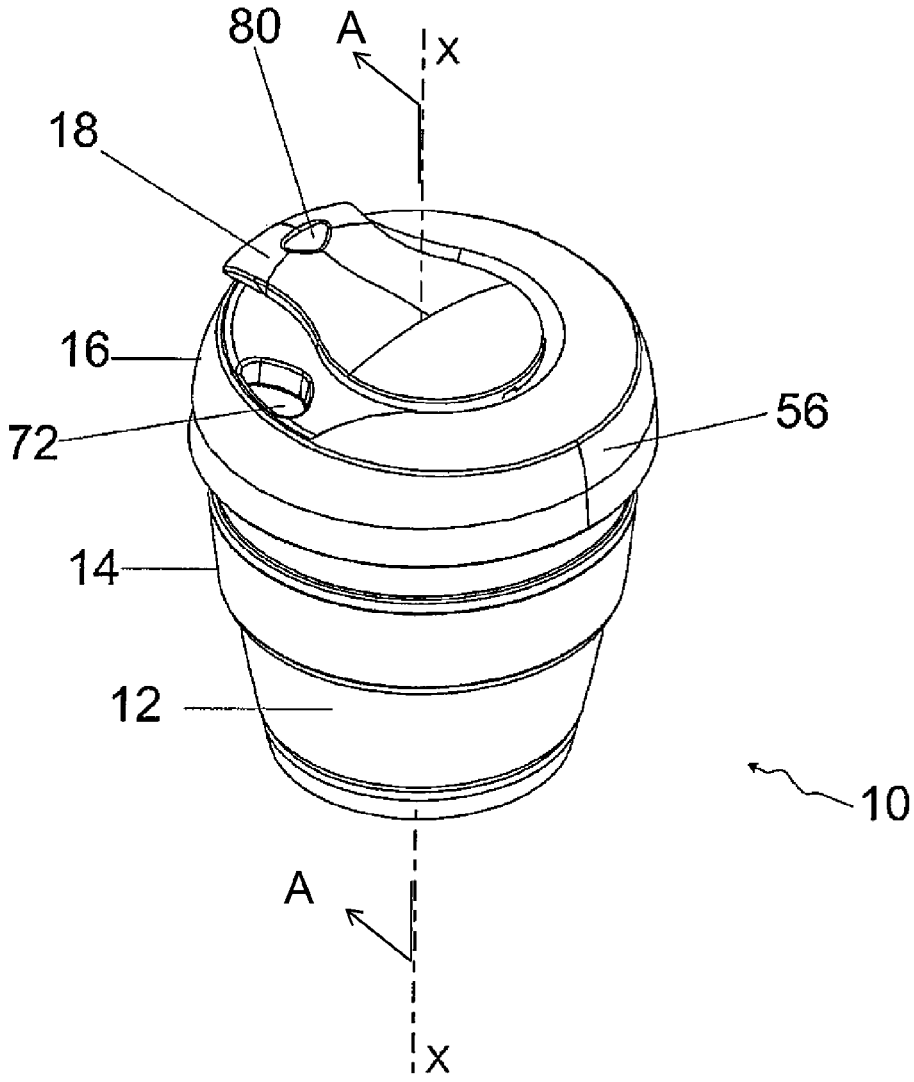
FIG. 1 is a top perspective view of a beverage cup in accordance with an embodiment of the present invention.

Although specific terms are used in the following description for sake of clarity, these terms are intended to refer only to particular structure of the invention selected for illustration in the drawings, and are not intended to define or limit the scope of the invention.

Figure 2:
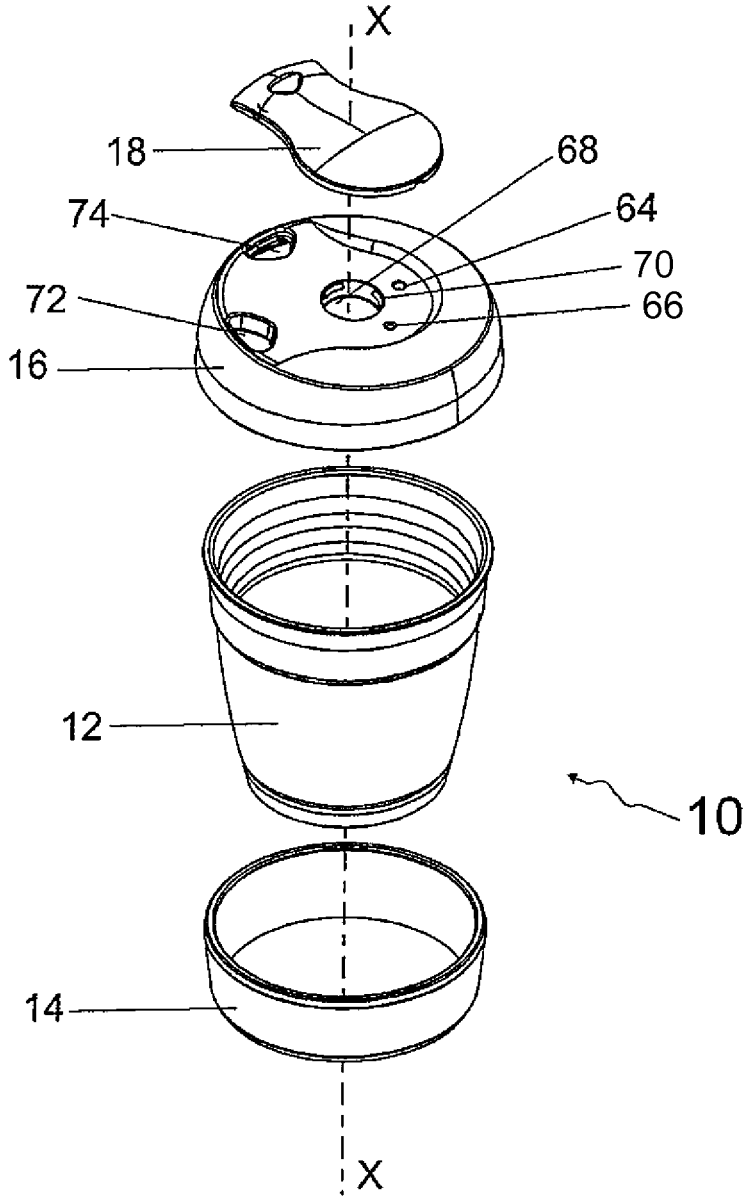
FIG. 2 is an exploded view of the cup of FIG. 1.

Referring initially to FIGS. 1 and 2, a reusable take-away beverage cup 10 constructed in accordance with the present invention is disclosed. Cup 10 is designed to contain and carry a wide variety of hot or cold liquid beverages such as, for example water, tea, ice tea, milk in general, and a wide variety of hot or cold coffees. Cup 10 includes a container 12, a sleeve 14 that sits on the container, a lid 16 attachable to the open top of the container and a rotatable member 18 that rotates on the lid 16, all of which are concentrically positioned to define a central longitudinal axis-X. Container 12, lid 16 and rotating member 18 are preferably made from reusable and flexible thermo-plastic polymers such as, for example, polypropylene in this one particular embodiment of the present invention. These polymers are rugged, tough and non-toxic and exhibit good resistance to fatigue. Sleeve 14 is made of an insulating and heat-resistant material such as, for example, silicone in this particular embodiment.

Figure 3:
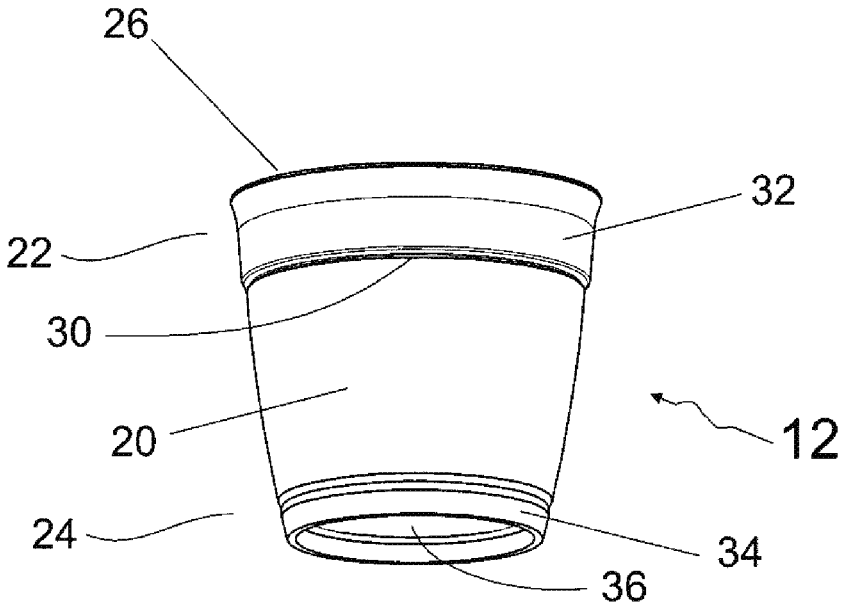
FIG. 3 is a front view of a container of the cup of FIG. 1.
Figure 4:
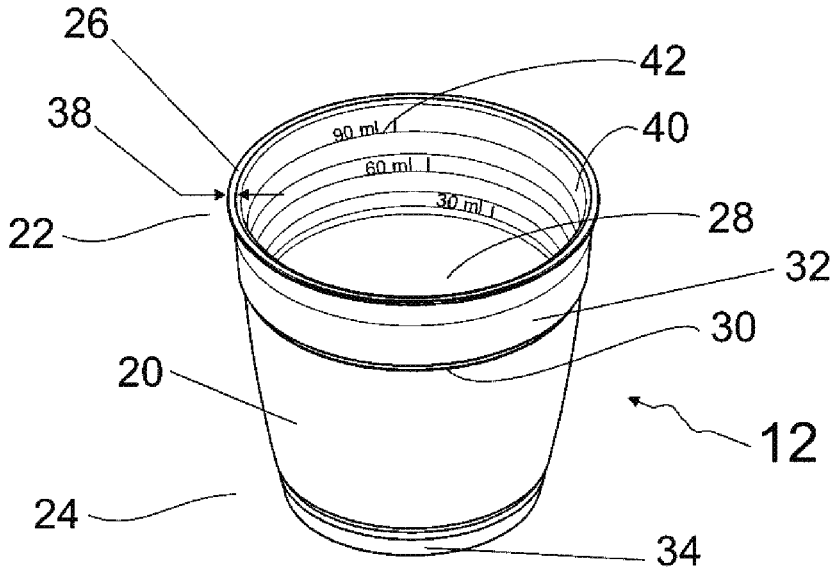
FIG. 4 is a top perspective view of the container of the cup of FIG. 1.
Figure 12:
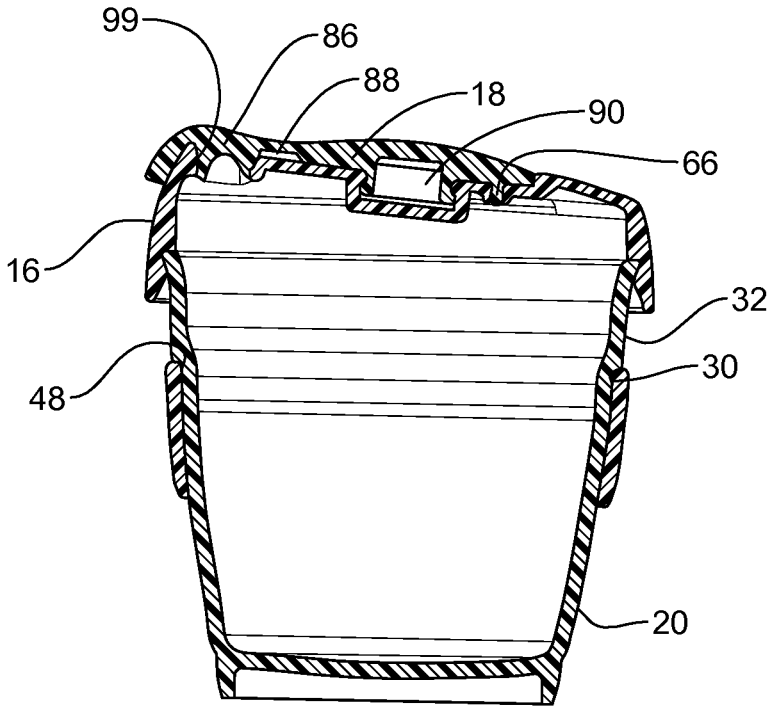
FIG. 12 is a side sectional view of the cup of FIG. 1.

Referring to FIGS. 3 and 4, container 12 has a side wall 20 that defines an upper end portion 22 and a lower end portion 24. The upper end portion 22 includes a top rim 26 that defines an opening 28 of container 12. The upper end portion 22 includes a channel 30. Channel 30 limits and holds sleeve 14 at a predefined distance from rim 26 where the distance is defined by an indication band 32 in side wall 20 that facilitates firm and exact abutment of sleeve 14 with channel 30. Channel 30 is an undercut in band 32 that receives a corresponding ridge 48, as illustrated in FIG. 12 and described in more detail below.

The lower end portion 24 defines a bottom rim 34. Bottom rim 34 extends vertically downwardly from a bottom wall 36. Bottom rim 34 prevents direct contact of bottom wall 36 with the surface on which the container 12 is placed and ensures the bottom of the cup is maintained relatively clean.

Side wall 20 and bottom wall 36 together define a tapered configuration adapted to comfortably fit into a head of any coffee vending machine. Top rim 26 has predefined lip or space 38 that laterally extends from the sidewall along a plane that is substantially perpendicular to the central longitudinal axis-X. Top rim 26 has a thickness that is approximately equal to the thickness of sidewall 20. It is understood, however, that the dimensions of rim 26 may vary in other alternative embodiments for the lid 16. Space 38 engages with lid 16 in a press fit arrangement.

Container 12 has an inner wall 40 that defines a cavity of a predefined volume. Inner wall 40 may have a plurality of circular markings 42 as illustrated in FIG. 4, wherein each indicates a predefined volume.

Figure 5:
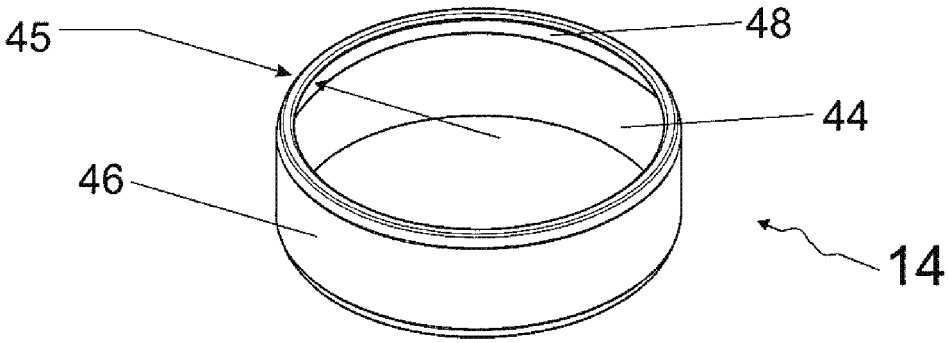
FIG. 5 is a top perspective view of a sleeve member of the cup of FIG. 1.
Figure 6:
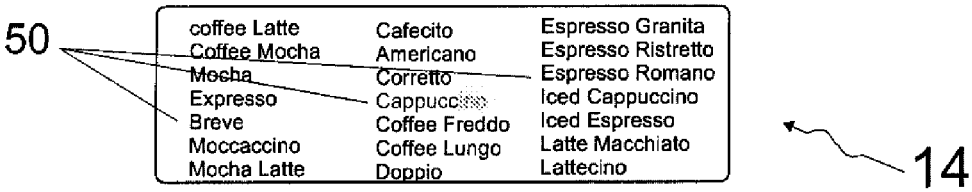
FIG. 6 is a front view of detail on the sleeve member of the cup of FIG. 1.

Referring to FIGS. 5 and 6, sleeve 14 has an inner surface 44 and an outer surface 46 that define a thickness 45. Inner surface 44 is adapted to be positioned over the container side wall 20 and directly under indication band 32. Inner surface 44 carries ridge 48 that has substantially the same width as that of channel 30 in order to locate within channel 30. Because the material of the cup is harder than that of the band, and namely in the embodiment described the cup is made of a plastic such as polypropylene while the band is made of silicon, ridge 48 is able to locate into channel 30 under slight compression, which assists in retaining the band on the container wall.

Outer surface 46 of sleeve 14 has a plurality of personalization marks 50, such as, for example, Cappuccino, Mocha, and Chai which may be used to indicate contents by a marking means. The personalization marks are illustrated in FIG. 6.

Figure 7:
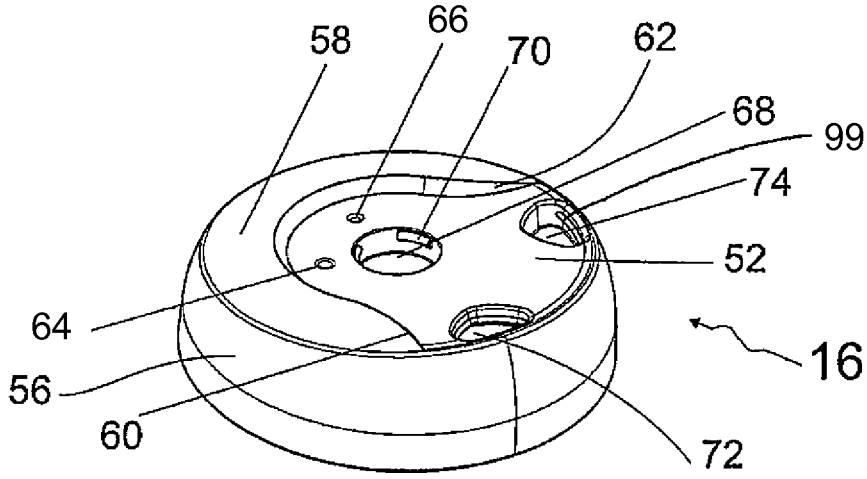
FIG. 7 is a top perspective view of a lid of the cup of FIG. 1.
Figure 8:
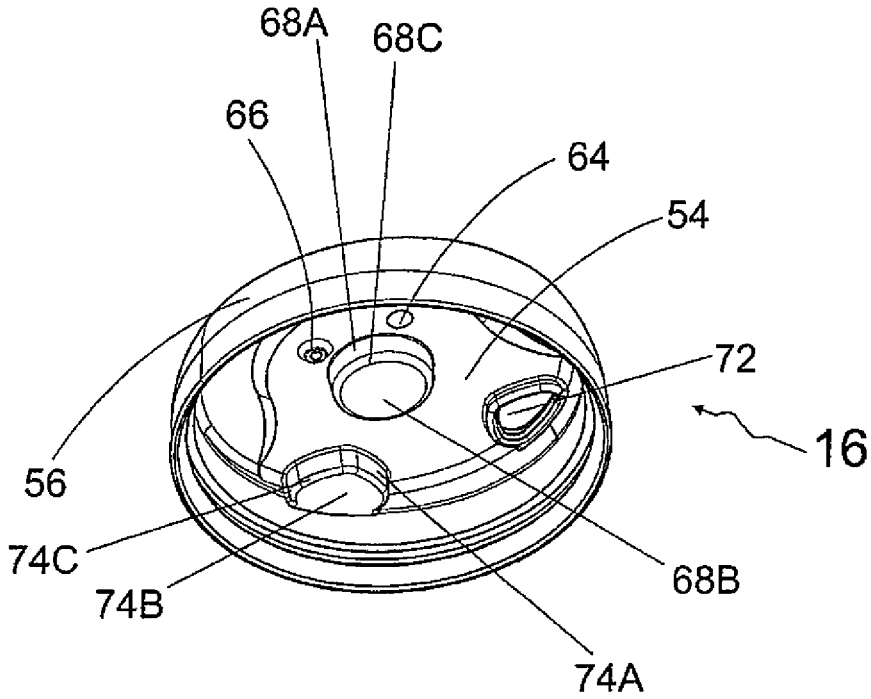
FIG. 8 is a bottom perspective view of the lid of the cup of FIG. 1.

Referring to FIGS. 1, 7 and 8, lid 16 has a top surface 52, a bottom surface 54 and a lid wall 56. The top surface 52 has a bulged or raised arcuate portion 58. Arcuate portion 58 defines boundaries on the top surface 52 within which the rotatable member 18 is allowed to swivel or rotate over the lid 16. Arcuate portion 58 is adapted to limit the movement of rotatable member 18 by the limits or boundaries defined by arcuate portion 58. Arcuate portion 58 has a first end 60 that aligns with a first side of the rotatable member 18 in a first position. Arcuate portion 58 has a second end 62 that aligns with a second side of rotatable member 18 in a second position.

Lid 16 includes an indentation 64 and an air hole 66. Indentation 64 has a configuration adapted to be engaged with a circular protrusion defined on rotatable member 18. Air hole 66 provides a vent to release pressure that builds up when hot beverage is poured and sealed in container 12. Lid 16 is centrally positioned with a circular indent 68. Indent 68 includes a plurality of projections 70 adapted to facilitate a snap-fit engagement with rotatable member 18. Indent 68 extends axially downwardly to define a sidewall 68A and a bottom wall 68B that adjoin at a junction rim 68C.

Lid 16 defines a triangular shaped opening 72 and a triangular shaped indent 74. Triangular shaped opening 72 has a relatively flat surface that controls and laterally distributes the flow of the beverage. The triangular shaped indent 74 extends axially downwardly to define a sidewall 74A and a bottom wall 74B that join at a junction 74C.

While the embodiment illustrated and described has an opening, and indent, that is triangularly shaped, it is understood that other shapes could be used such as oval, round, square, trapezoid or the like. In a preferred embodiment, and in order to better distribute the flow of beverage through the opening in smaller cups, the opening has a shape that is wider towards the outer perimeter of the lid than towards the centre. In other words, the shape narrows from a radially outer position on the lid to a radially inner position. A triangle, trapezoid or a free-formed shape having a wider base than top, would satisfy such a requirement. In larger cups it is forseeably sufficient to have an opening that is round, oval, rectangular or the like.

Figure 9:
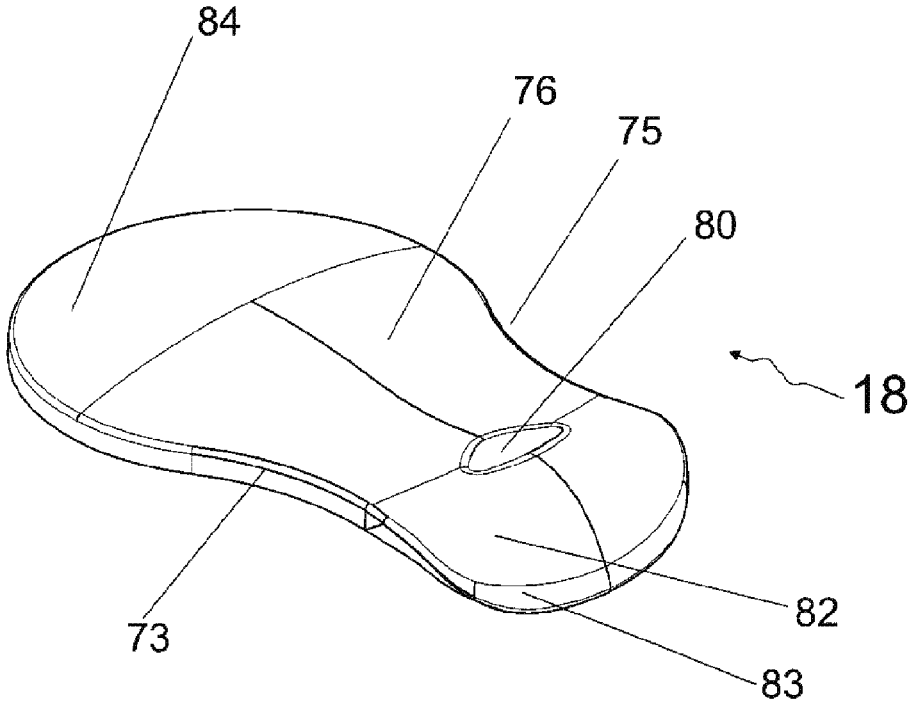
FIG. 9 is a top perspective view of a plug of the cup of FIG. 1.
Figure 10:
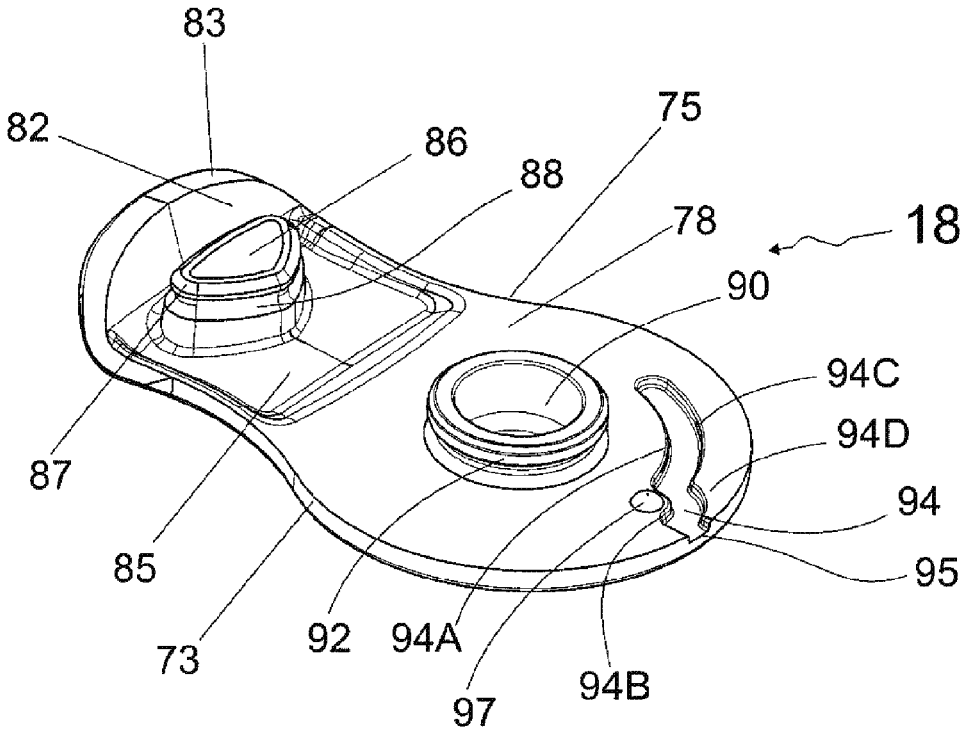
FIG. 10 is a lower perspective view of the plug of the cup of FIG. 1.

Referring to FIGS. 1, 9 and 10, rotating member 18 has a first side 73, a second side 75, a top surface 76 and a bottom surface 78. The top surface 76 includes a triangular shaped indent 80. Indent 80 is adapted to position a finger, preferably a thumb, for comfortable lifting and swiveling of plug 86. Rotatable member 18 has a member 84 that remains in fixed but pivotal relation to the lid 16, and tab 82 that assists in lifting and turning of rotating member 18. Tab 82 has an end portion 83 that positions over a lid wall 56. Referring to FIGS. 1, 9 and 10, rotating member 18 has a first side 73, a second side 75, a top surface 76 and a bottom surface 78. The top surface 76 includes a triangular shaped indent 80. Indent 80 is adapted to position a finger, preferably a thumb, for comfortable lifting and swiveling of plug 1886. Rotatable member 18 has a member 84 that remains in fixed but pivotal relation to the lid 16, and tab 82 that assists in lifting and turning of rotating member 18. Tab 82 has an end portion 83 that positions over a lid wall 56.

Bottom surface 78 has a platform 85 that has a square configuration. Platform 85 defines a protrusion, or plug, 86 that has a mating end 87. The protrusion 86 is similarly shaped to opening 72 as it is adapted to locate in opening 72. In the drawings the plug is illustrated triangular in shape and together with opening 72, has cooperating engagement parts. Specifically, plug 86 has a triangular neck 88 that facilitates a snap fit arrangement with triangular shaped opening 72 and triangular shaped indent 74.

Neck 88 forms a ridge around plug 86 that cooperates in a snap fit engagement with one or more raised projections, or detents 99, on an inner wall of opening 72 so as to retain the plug in the opening and to also provide a seal between the plug and opening that prevents escape of fluid through the opening. For better sealing, detent 99 may extend as a single projection around the internal periphery of the opening 72, or it would suffice to provide one or more short projections on the internal periphery with gaps therebetween. FIG. 12 illustrates the interrelationship between the plug 86 and opening 72.

The bottom surface 78 has a central circular protrusion 90. Circular protrusion 90 has a raised circular edge 92 that provides a snap fit arrangement with the projections 70 defined on central indent 68.

Bottom surface 78 has a guiding track 94 that has an arcuate shaped configuration defined by a first curved portion 94A, a second curved portion 94B, a third curved portion 94C and a fourth curved portion 94D. The guiding track 94 is adapted to assist in rotational movement of rotatatable member 18 over the lid 16. Guiding track 94 defines a slot 95 along the periphery of the rotating member 18 adapted to carry and release hot air or steam released through air hole 66. Bottom surface 78 has a circular protrusion 97 positioned beside guiding track 94. Protrusion 97 is adapted to position over air hole 66 in the first position of the rotating member 18 to close the air hole 66 when the rotatable member closes the lid opening by locating plug 86 in opening 72. Protrusion 97 is adapted to position over indentation 64 in the second position of the rotatable member 18 to open air hole 66 when the rotatable member has moved to open the lid opening 72.

Figure 11:
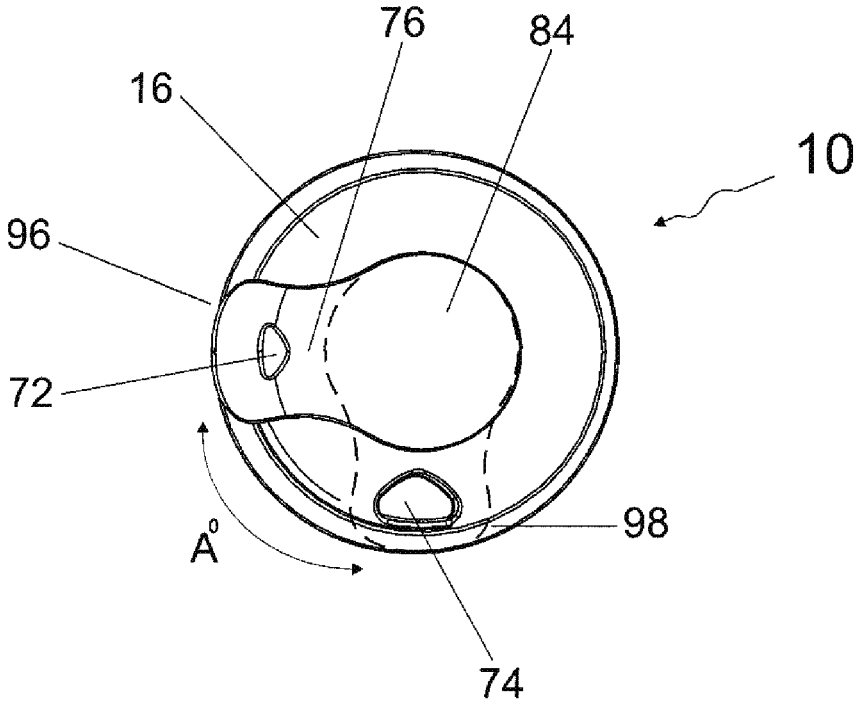
FIG. 11 is a top view of the cup of FIG. 1.

Referring to FIGS. 1 and 11, rotatable member 18, in operation, has a first position 96 and a second position 98. Rotatable member 18 securely engages in a snap fit arrangement with the projections 70 of central indent 68 in both first and second positions 96, 98. Central protrusion 90 when engaged in a snap fit arrangement also pivots or rotates about central axis-X (See FIG. 1). The movement of rotatable member 18 between the first and second positions 96, 98 is guided and secured by projections 70 and guiding track 94.

In the first position 96, the rotatable member 18 is positioned over the triangular shaped opening 72 such that triangular protrusion 86 of the rotatable member 18 is secured in a snap-fit arrangement with the triangular shaped opening 72. In the first position 96, triangular protrusion 86 effectively seals the container 12 to make it spill-proof.

In the second position 98, the rotatable member 18 is swiveled in predefined angle A° and positioned over the indent 74. The rotational movement of the rotatable member 18 is facilitated by pivoting central protrusion 90 within indent 68. In this particular embodiment, angle A° is substantially 90°. However, it is understood that angle A° may vary in other alternative embodiments.

In Operation

Referring to FIGS. 1-11, the use and operation of the present invention is described. A user can use the cup 10 of the present invention in almost any coffee shop since configuration of the container 12 is similar to the take-away disposable paper cups that are available with the coffee outlet. Therefore, the cup 10 is adapted to be used with almost any group head of any coffee machine.

The user comes to a coffee shop and instead of the usual disposable paper cup asks for the cup 10 of the present invention or brings one such cup with them. The user preferably highlights one of the personalization marks 50 to mark his choice. The user hands the cup to a barista. The barista removes the lid 16 by pressing together container 12 and the lid 16. The barista fills the container 12 with the favourite coffee of the user, as indicated per personalization mark 50 on sleeve 14, and hands back the cup 10 to the user.

The user takes the cup 10 from the barista and press-fits the lid 16 over the container 12. The user may either sip the coffee from the triangular shaped opening 72 of the cup 10 or seal the triangular shaped opening 72 using rotatable member 18. The sealing of the triangular shaped opening 72 is spill-proof, and the user can carry the cup 10 filled with their favorite beverage wherever they go.

The rotatable member 18 is snap-fitted within not only the triangular shaped opening 72 but also within central indent 68. To sip the coffee from the sipping hole 72, the user first pulls the tab 82 up from the triangular shaped opening 72, and then swivels rotatable member 18 towards triangular indent 74 to place it inside indent 74.

Thus, upward movement of tab 82 and lateral swiveling movement of rotatable member 18 are required to access triangular shaped opening 72 and acts as an important safety feature. This safety feature is particularly important, in case of users such as children and elderly people who have either not acquired or lost motor skills to open even a reusable and flexible coffee cup and, thereby, may accidently spill over coffee, or other beverages, while opening ordinary reusable beverage cups.

Another important aspect of the container 10 in accordance with the present invention is that it is modular in construction and personalization. All the four parts namely, container 12, sleeve 14, lid 16 and rotatable member 18 are customizable. Therefore, a user can shop and choose from a variety of colors that are made available and personalize cup 10 according to personal tastes. Lid 16 can be used with containers of various sizes. Further, the modularity of design adds more reusability to cup 10, since every part of the cup 10 is replaceable, reusable and interchangeable. Thus, cup 10 constructed in accordance with the present invention further helps the user to reduce carbon footprint and enjoy a greener lifestyle. Additionally, disposable takeaway beverage cups come in standard sizes. The present beverage cup replicates this standard sizing.

The embodiments of the invention shown and discussed herein are merely illustrative of modes of application of the present invention. Reference to details in this discussion is not intended to limit the scope of the claims to these details, or to the figures used to illustrate the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A reusable beverage cup comprising:

a container;

a lid having a sipping opening and adapted to fit on the container; and a rotatable member on the lid having a plug that is fixed to a bottom surface of the rotatable member and adapted to locate in the opening to sealingly close the opening when the rotatable member is in a first position on the lid, wherein the plug and opening are similar in shape, and the rotatable member is arranged to swivel laterally on the lid away from the first position, wherein an air hole defined on the lid is adapted to be covered by the rotatable member in the first position of the rotatable member and wherein the rotatable member includes an arcuate shaped guiding track including a mating slot adapted to carry hot air or steam released through the air hole.

2. The reusable beverage cup of claim 1, wherein the plug and opening have cooperating engagement parts.

3. The reusable beverage cup of claim 2, wherein the plug includes a neck on its periphery that engages with one or more projections on an inner periphery of the opening to snap fit the plug into the opening.

4. The reusable beverage cup of claim 1, wherein the opening and plug have a shape that is wider towards an outer perimeter of the lid than towards a centre.

5. The reusable beverage cup of claim 4, wherein the opening and plug are triangular or trapezoidal in shape.

6. The reusable beverage cup of claim 1, wherein the cup includes a sleeve that fits around the container and that has a plurality of personalization marks adapted to be used to indicate contents.

7. The reusable beverage cup of claim 6, wherein the sleeve has an upper ridge that is adapted to locate within a channel formed on an exterior of the container.

8. The reusable beverage cup of claim 1, wherein a base of the container has a bottom wall that is spaced from a surface on which the reusable beverage cup can be placed, by a bottom rim.

9. The reusable beverage cup of claim 1, wherein an arcuate shaped bulged portion on the lid is adapted to define turning boundaries of the rotatable member along which the rotatable member turns from the first position to a second position to hold the rotating member in a triangular shaped indent defined on the lid.

10. The cup of claim 1, wherein the rotatable member is adapted to rotate by a predefined angle.

11. The cup of claim 1, wherein the rotatable member swivels laterally on the lid between the first position wherein the plug sealingly closes the opening and a second position wherein the plug is moved away from the opening.

* * * * *